United States Patent [19]

Koreicho

[11] 4,408,734

[45] Oct. 11, 1983

[54] SYSTEM FOR GUIDING A MISSILE BY LIGHT BEAM

[75] Inventor: Wladimir Koreicho, Chilly Mazarin, France

[73] Assignee: Societe Anonyme de Telecommunications, Paris, France

[21] Appl. No.: 227,818

[22] Filed: Jan. 23, 1981

[30] Foreign Application Priority Data

Jan. 29, 1980 [FR] France ..... 80 01840

[51] Int. Cl.[3] ..... F41G 7/26

[52] U.S. Cl. ..... 244/3.13

[58] Field of Search ..... 244/3.13

[56] References Cited

U.S. PATENT DOCUMENTS

| | | | |
|---|---|---|---|
| 3,000,255 | 9/1961 | Iddings | 88/1 |
| 3,690,594 | 9/1972 | Menke | 244/3.13 |
| 4,014,482 | 3/1977 | Esker et al. | 244/3.13 |
| 4,149,686 | 4/1979 | Stauff et al. | 244/3.13 |
| 4,243,187 | 1/1981 | Esker | 244/3.13 |

FOREIGN PATENT DOCUMENTS

| | | |
|---|---|---|
| 1292509 | of 0000 | Fed. Rep. of Germany . |
| 1604956 | of 0000 | France . |
| 1605053 | of 0000 | France . |
| 2339832 | of 0000 | France . |

OTHER PUBLICATIONS

"Reticles in Electro-Optical Devices", L. M. Biberman.

*Primary Examiner*—Charles T. Jordan

*Attorney, Agent, or Firm*—Holman & Stern

[57] ABSTRACT

System for guiding a missile, comprising a source emitting a light beam of which the axis defines the direction of sight, at least one modulation sight placed in the path of the beam, means for producing a relative movement of rotation between the sight and the beam, and on the missile, at least one detector and a calculating circuit for determining, from the output signal from the detector, the coordinates of the detector with respect to the direction of sight.

The control surfaces of the missile are actuated as a function of said coordinates with a view to controlling the path of the missile on the direction of sight.

The modulation sight comprises transparent and opaque, and possibly semi-transparent sectors, defined by curves symmetrical with respect to the center of the sight, at least certain of these curves having for equation $f(\rho, \theta \text{ modulo } \pi)=O$, where $\rho$varies monotonically as a function of $\theta$, and defining 2n angles at the center which are equal whatever the radius in question, so that the duration of relative illumination of the detector remains equal to 50%, whatever its positio

6 Claims, 8 Drawing Figures

FIG_1
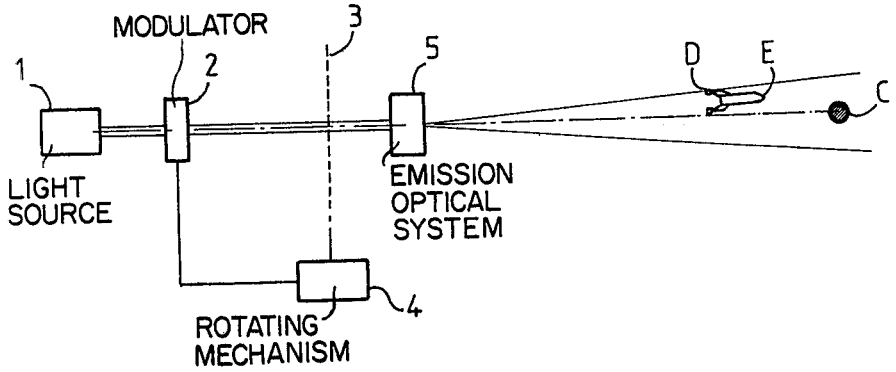
FIG_2
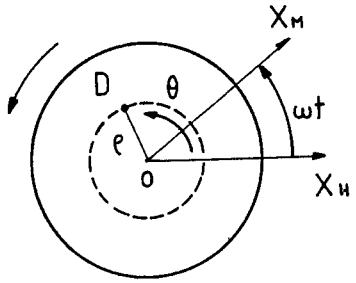
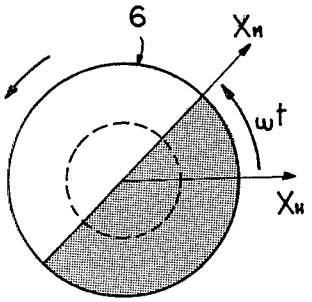
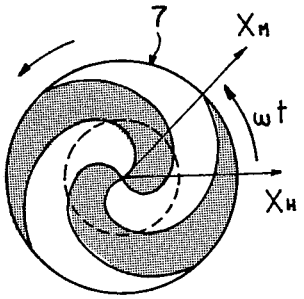
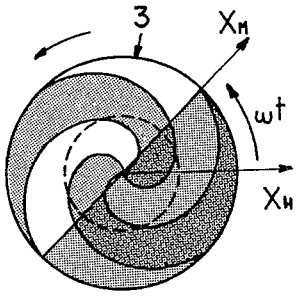
FIG_4a FIG_4b FIG_3

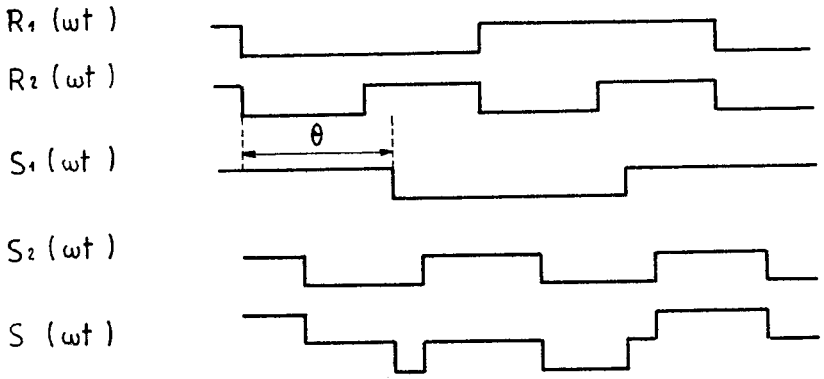
FIG _ 5
FIG_6a
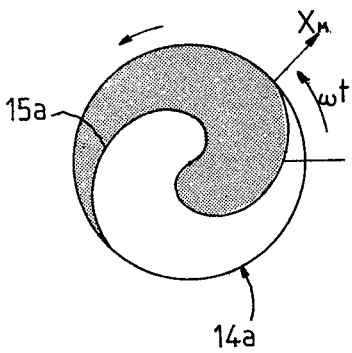
FIG_6b
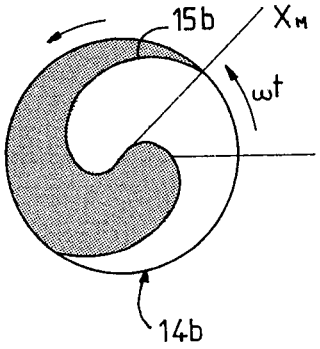

SYSTEM FOR GUIDING A MISSILE BY LIGHT BEAM

BACKGROUND OF THE INVENTION

1. Field of The Invention

The present invention relates to a missile guiding system comprising a source emitting a light beam of which the axis defines the direction of sight, at least one modulation sight placed in the path of the beam, means for producing a relative movement of rotation between the sight and the beam and, on the missile, at least one detector and a calculating circuit for determining, from the output signal from the detector, the coordinates of the detector with respect to the direction of sight, the control surfaces of the missile being actuated as a function of said coordinates with a view to controlling the path of the missile on the direction of sight.

2. Description of The Prior Art

French Pat. No. 2,339,832 discloses a guiding system comprising, for modulating the beam, a rotating sight in spiral form. By measuring the durations of illumination of each detector, the distance from the detector to the axis of the beam is determined since, given the form of the sight, the duration of illumination is a function of the distance to the axis.

However, in this known system, the duration of illumination is very variable with respect to the total duration of measurement and in particular the relative duration of illumination is close to 100% on the axis of the beam and reduces on moving away from the axis until it becomes close to 0 at the limit of the field. This is a considerable drawback from the point of view of the link balance as, in this respect, the optimal value of the relative duration of illumination is equal to 50%.

It is an object of the present invention to provide a guiding system of the above-described type, in which the relative duration of illumination of the detector remains equal to 50% whatever the position of the detector.

SUMMARY OF THE INVENTION

To this end, the modulation sight comprises transparent and opaque, and possibly semi-transparent sectors, defined by curves symmetrical with respect to the center of the sight, at least certain of these curves having for equation $f(\rho, \theta \text{ modulo } \pi)=0$, where $\rho$ varies monotonically as a function of $\theta$, and defining 2n angles at the center which are equal whatever the radius in question, so that the duration of relative illumination of the detector is equal to 50%, whatever its position.

According to one embodiment, the sight is formed as the superposition of a first sight divided into a transparent sector and a semi-transparent sector, which are semi-circular, and of a second sight divided into four equal sectors, namely two transparent sectors and two semi-transparent sectors, by two curves of equation $f(\rho, \theta \text{ modulo } \pi)=0$.

According to another embodiment, two identical sights are provided, alternately occupying an active position of beam interception, each sight being divided into two identical sectors by a curve of equation $f(\rho, \theta \text{ modulo } \pi)=0$.

BRIEF DESCRIPTION OF THE DRAWINGS

The invention will be more readily understood on reading the following description with reference to the accompanying drawings, in which:

FIG. 1 is a schematic view of the guiding system according to the invention.

FIG. 2 shows the section of the guiding beam at the level of the detector of the missile.

FIG. 3 shows a first embodiment of the modulation sight.

FIGS. 4*a* and 4*b* show the sight designs of which the superposition gives the pattern of FIG. 3.

FIG. 5 is a signal diagram illustrating the principle of modulation.

FIGS. 6*a* and 6*b* illustrate another embodiment of the modulation means.

DETAILED DESCRIPTION OF PREFERRED EMBODIMENTS

Referring now to the drawings, the guiding system shown in FIG. 1 comprises a light source 1, for example a laser source emitting in the infrared, such as a $CO_2$ laser. A continuously emitting laser is preferably used in the invention, but the use of an electroluminescent diode of the AsGa type may also be envisaged.

The beam emitted by the source 1 is modulated in amplitude at a high frequency by an electro-optical modulator 2 which is designed to furnish an angular reference. To this end, the modulation frequency of the beam is modified in determined manner, in synchronism with the rotation of the sight described hereinafter.

The beam issuing from the modulator 2 is modulated by a rotating sight 3 rotated at an angular speed $\omega$ by a mechanism 4 and described in greater detail hereinafter. As the important point is that a relative movement of rotation takes place between the sight 3 and the beam, the sight may also be fixed and the beam may be rotated, for example, by means of a Wollaston prism. The resulting beam then passes through an emission optical system 5.

The missile E goes towards the target C on which the beam is directed. It carries one, or more than one, detector D which converts the light radiation that it receives from the source 1 into an electric signal. As the light beam is modulated, the electric signal is also modulated and the principle of modulation, set forth hereinafter, is such that the polar coordinates $(\rho, \theta)$ of the detector D with respect to the axis of the beam may be deduced from the output signal from the detector.

The signals indicative of said coordinates are applied to the circuit controlling the control surfaces provided on the missile, so as to control the path of the missile on the axis of the beam.

It should be noted that the emission optical system 5 is designed to maintain substantially constant the section of the beam projected at detector level, and therefore the light power received by the detector. The optical system 5 is provided to this end with a device of the zoom type.

The sight 3 shown in FIG. 3 may be considered as the superposition of two sights 6 and 7 shown respectively in FIGS. 4*a* and 4*b*.

The first sight 6 is composed of a transparent sector and of a semi-transparent sector, semi-circular in form. The resultant modulation component in the output signal from the detector D is the signal $S_1(\omega t)$ (cf. FIG. 5).

Due to the variation of frequency effected by the modulator 2 in synchronism with the rotation of the sight 3, the processing circuit provided on the missile elaborates a reference signal $R_1$ ($\omega t$) of the same frequency corresponding to the axis $x_H$ and it is clear that the polar angle $\theta$ may be easily determined by measuring the phase shift between $S_1$ ($\omega t$) and $R_1$ ($\omega t$).

The sight 7 shown in FIG. 4*b* defines four identical sectors, alternately transparent and semi-transparent, which are defined by sections of Archimedes' spiral of equations $\rho = a$ ($\theta$ modulo $\pi$) and $$\rho = a\left(\left(\theta + \frac{\pi}{2}\right) \text{ modulo } \pi\right).$$

The corresponding modulation component is represented by the signal $S_2(\omega t)$, and it will be readily understood that the phase-shift of $S_2$ ($\omega t$) with respect to a reference signal $R_2(\omega t)$, of which the frequency is double that of $R_1$ ($\omega t$), is a function of the radius vector $\rho$. This phase shift is given by the relationship $$\phi = \theta - (\rho/a)$$

and as $\theta$ may be determined by the phase shift between $S_1$ ($\omega t$) and $R_1$ ($\omega t$), it is also easy to determine $\rho$.

The signals $S_1$ and $S_2$ are easily deduced from the signal S ($\omega t$) which is obtained at the output of the detector D after amplification and appropriate shaping.

Concerning the sight shown in FIG. 3, it should be noted that it comprises transparent sectors (100% illumination), semi-transparent sectors (50% illumination), represented in spaced hatching, and opaque sectors (0% illumination), represented in close hatching. The sight of FIG. 3 should not be considered as being formed by the superposition of the sights of FIGS. 4*a* and 4*b*, as the superposition of two semi-transparent sectors would not give complete opacity. The sights of FIGS. 4*a* and 4*b* are imaginary and are shown only for explanatory purposes.

It should be emphasized that, for each of the imaginary sights of FIGS. 4*a* and 4*b*, the duration of total illumination, corresponding to the sum of the angles at the center defined by the transparent sectors would be equal to the duration of semi-illumination, corresponding to the sum of the angles at the center defined by the semi-transparent sectors, whatever the radius in question. This results in the relative duration of illumination of the sight of FIG. 3 being equal to 50% whatever the radius in question, this relative duration being equal to 100. $\Sigma_{ET}+50$. $\Sigma_{SE}$, $\Sigma_{ET}$ and $\Sigma_{SE}$ designating the sum of the angles at the center defined respectively by the transparent sectors and the semi-transparent sectors of the sight.

As has been indicated previously, this is a very advantageous characteristic from the point of view of the link balance of the system.

In addition, still from the standpoint of the link balance, the invention makes it possible to obtain a maximum signal variation, as well as a variation of the parameters $\rho$ and $\theta$, in likewise maximum extents of measurement.

FIGS. 6*a* and 6*b* illustrate another embodiment of the modulation means. In this case, two sights 14*a* and 14*b* are provided which are moved rhythmically by a switching mechanism (not shown) so that the beam is modulated in turn by the sight 14*a* and by the sight 14*b*.

The sights 14*a* and 14*b* are identical and each formed by two identical sectors defined by a curve 15*a*,15*b*, formed by two sections of Archimedes' spiral $\rho = a\theta$ and $\rho = -a\theta$ symmetrical with respect to the center of the sight. The two sights are phase shifted by a given angle, which is 180° in the example shown. Means are of course provided to create a movement of rotation between the beam and the sights, for example an optical member rotating the beam or a mechanism for rotating the sights in the same direction at the same angular speed $\omega$.

As indicated previously, the components attributable to the respective sights are deduced from the output signal from the detector D and their phase shift $\phi_a$, $\phi_b$ is determined with respect to a reference signal.

The phase shifts are given by the relationships:

$$\phi_a = \theta - (\rho/a) \text{ and } \phi_b = \theta + (\rho/a)$$

from which are drawn $$\theta = \frac{\rho a + \rho b}{2} \text{ and } \rho = a\frac{(\rho b - \rho a)}{2}$$

The processing circuit for calculating $\rho$ and $\theta$ is not described here, as it is quite within the competence of the man skilled in the art.

The embodiment shown in FIGS. 6*a* and 6*b* requires only one reference signal R ($\omega t$) instead of two in the embodiment of FIGS. 3*a* and 3*b*. It is also more advantageous from the point of view of diffraction.

As a variant, the sights 14*a* and 14*b* may be rotated at the same speed, but in opposite directions.

In the embodiments described, the curves defining the sectors are sections of Archimedes' spiral, which furnishes a linear relationship between $\rho$ and $\theta$. However, the invention is not limited to this type of curve and any curve of equation $f(\rho, \theta)=0$, where $\rho$ varies monotonically as a function of $\theta$, may be more generally envisaged.

I claim:

1. In a system for guiding a missile, comprising a source emitting a light beam of which the axis defines the direction of sight, at least one modulation sight placed in the path of the beam, means for producing a relative movement of rotation between the sight and the beam, and, on the missile, at least one detector and a calculating circuit for determining, from the output signal from the detector, the coordinates of the detector with respect to the direction of sight, the control surfaces of the missile being actuated as a function of said coordinates with a view to controlling the path of the missile on the direction of sight, the improvement comprising the modulation sight comprises transparent and opaque, and possibly semi-transparent sectors, defined by curves symmetrical with respect to the center of the sight, at least certain of these curves having for equation $f(\rho,\theta \text{ modulo } \pi)=0$, where $\rho$ varies monotonically as a function of $\theta$, and defining 2n angles at the center which are equal whatever the radius in question, so that the duration of relative illumination of the detector remains equal to 50%, whatever its position.

2. The system of claim 1, wherein said sight is formed as the superposition of a first sight divided into a transparent sector and a semi-transparent sector, which are semi-circular, and of a second sight divided into four equal sectors, namely two transparent sectors and two semi-transparent sectors, by two curves of equation $f(\rho,\theta \text{ modulo } \pi)=0$.

3. The system of claim 1, wherein two identical sights are provided, occupying in turn an active position of beam interception, each sight being divided into two identical sectors by a curve of equation $f(\rho,\theta \text{ modulo } \pi)=0$.

4. The system of claim 3, wherein said two sights rotate in the same direction and are phase shifted.

5. The system of claim 3, wherein said two sights rotate in opposite directions.

6. The system of one of claims 1, 2, 3, 4 or 5, wherein each of said curves is formed by two sections of Archimedes' spiral of equations $\rho=a\theta$ and $\rho=-a\theta$, respectively.

* * * * *